United States Patent [19]

Vural

[11] 4,003,203

[45] Jan. 18, 1977

[54] HYDRAULIC EXCITER OF VIBRATIONS FOR A VIBRATORY COMPACTOR

[75] Inventor: Gulertan Vural, Emmelshausen, Germany

[73] Assignee: Koehring GmbH - BOMAG Division, Boppard, Germany

[22] Filed: Nov. 25, 1974

[21] Appl. No.: 527,051

Related U.S. Application Data

[62] Division of Ser. No. 372,622, June 22, 1973, Pat. No. 3,849,986.

[30] Foreign Application Priority Data

June 24, 1972 Germany ..... 2231106

[52] U.S. Cl. ..... 60/537; 91/466

[51] Int. Cl.[2] ..... F15B 7/02

[58] Field of Search ..... 60/537, 532, 545, 539

[56] References Cited

UNITED STATES PATENTS

| | | | |
|---|---|---|---|
| 1,343,836 | 6/1920 | Lewis | 60/537 |
| 2,350,117 | 5/1944 | Kline | 60/537 |
| 3,266,217 | 8/1966 | Van Den Dos | 60/537 |
| 3,762,160 | 10/1973 | Kromer | 60/537 |

*Primary Examiner*—Paul E. Maslousky
*Attorney, Agent, or Firm*—Spencer & Kaye

[57] ABSTRACT

A hydraulic exciter of vibrations for a vibratory compactor includes an exciter containing a piston which is movable to and fro in the cylinder and either the piston or the cylinder is connected to a compacting member. The movement of the piston in the cylinder is brought about either by an alternating source of hydraulic fluid pressure which forces fluid alternately into and out of the exciter cylinder to move the piston to and fro or by means of a uni-directional source of hydraulic fluid under pressure formed by a hydraulic pressure pump together with a control valve in between the pump and the exciter cylinder. The control valve is operated to switch the supply of hydraulic fluid to and fro in the cylinder from one side of the piston to the other to produce the relative to and fro movement of the piston in the cylinder. The control valve has means for varying its speed of operation to vary the frequency of the vibrations produced by the exciter.

1 Claim, 8 Drawing Figures

HYDRAULIC EXCITER OF VIBRATIONS FOR A VIBRATORY COMPACTOR

CROSS-REFERENCE TO RELATED APPLICATION

This application is a division of copending application Ser. No. 372,622, filed June 22, 1973 now U.S. Pat. No. 3,849,986.

This invention relates to hydraulic exciters of vibrations for vibratory compactors of the kind which include a piston and a cylinder which are relatively movable to and fro and the movable part of which is arranged to be fixed to a compacting member. The piston and the cylinder may either reciprocate or oscillate one relative to the other. Where reciprocation takes place along a straight line, such exciters are sometimes known as linear stroke motors, whereas when the motion is oscillatory, they are known as oscillating piston or cylinder motors. Oscillating piston or cylinder motors are particularly useful for driving vibratory compactors of the shaking or joggling type.

Exciters of the kind described usually have the entry of the hydraulic fluid under pressure to the cylinder controlled by valves which are mounted in the cylinder and are actuated by the piston at the ends of its stroke relative to the cylinder. However these valves are subject to so much wear and tear that they have not been entirely successful. What is more, with this arrangement, the power output of the exciter is directly dependent upon the frequency of operation as the stroke of the exciter cannot be altered. As the pressure of the supply of hydraulic liquid increases, the frequency and therefore the power output of the exciter increases, but no other control is possible.

The aim of the present invention is to overcome these disadvantages of vibration exciters of the kind described so that the power output of the exciter can be varied independently of the hydarulic fluid pressure.

According to this invention, in a hydraulic exciter of vibrations for a vibratory compactor including an exciter piston and an exciter cylinder which are relatively movable to and fro and the movable part of which is arranged to be connected to a compacting member, the cylinder is connected by a conduit to a source of hydraulic fluid under pressure, the fluid in the conduit being itself caused, in use, to move to and fro by the source, or the source including a pressure pump which is arranged to produce a unidirectional flow of hydraulic fluid under pressure and the conduit having, in between the pump and the cylinder, a control valve which, in use, switches the supply of fluid to and fro in the cylinder from one side of the piston to the other to produce the relative to and fro movement between the piston and the cylinder and the control valve having means for varying its speed of operation to vary the frequency of the vibrations produced by the exciter.

With this arrangement there are no longer any valves in the cylinder itself operated by the piston so that the previous excessive wear is avoided. Further, it is possible to alter the frequency of the relative to and fro movement of the piston and the cylinder by altering the frequency of the source or altering the frequency of operation of the control valve without altering the pressure of the fluid supply.

When the hydraulic fluid is caused by the source to move to and fro, the source may include a cylinder containing a piston and a crank mechanism for reciprocating the piston in the cylinder. Moreover, instead of just a single cylinder and piston, the soruce may include a second cylinder with a second piston and means by which the movement of the second piston can be adjusted in phase relative to that of the first piston to adjust the volume of fluid supplied per stroke and hence adjust the stroke of relative movement of the exciter cylinder and piston.

The contruction of the source in this manner has the advantage of providing a smooth regulation of the output of the exciter. Both the length of the stroke of the exciter and its output can be altered between zero and a maximum value in a manner which is free from hydro-dynamic losses and is independent of the frequency of the exciter. With conventional exciters, on the other hand, adjustment of the power output and of the frequency can only be made in an inter-dependent manner.

When the source of hydraulic fluid under pressure comprises two cylinders and pistons, the two pistons are preferably driven by cranks on a common crank shaft and the second cylinder is arranged so that it can be swung about the axis of the crank shaft to bring about the phase adjustment.

It is preferred for the exciter piston to be movable and to be fixed to the compacting member. The source of hydraulic fluid under pressure may then include twin cylinders and pistons, the cylinders being connected to the exciter cylinder one for supplying fluid to each side of the exciter piston. With this arrangement the twin pistons which have to be driven exactly out of phase with each other, are preferably operated by a common crank mechanism.

A number of examples of hydraulic vibration exciters constructed in accordance with the invention are illustrated highly diagrammatically in the accompanying drawings in which.

Figure 1:
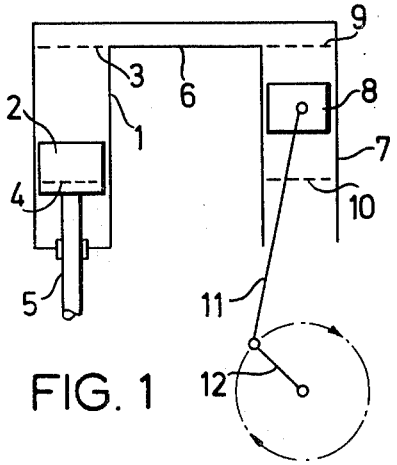
FIG. 1 is a side view of a first example in which both the exciter cylinder and piston and the source of fluid under pressure are arranged as linear stroke motors.

In the example shown in FIG. 1, the exciter comprises an exciter cylinder 1 containing an exciter piston 2. The top dead center position of the piston 2 is indicated at 3 and the bottom dead center position at 4. The piston 2 has a piston rod 5 fixed to it and the rod is attached to a compacting member in the form of a vibratory plate, which is not shown.

The exciter cylinder 1 and the parts of the exciter by which is it carried take part, together with the piston 2, in the vibrations produced by the exciter, but the exciter cylinder 1 is connected by a flexible conduit 6 to a pressure source cylinder 7 which does not vibrate. The pressure source cylinder 7 contains a piston 8 which is reciprocated between a top dead center position 9 and a bottom dead center position 10 by a crank 12 which is connected to the piston 8 by a connecting rod 11. The spaces within the cylinders 1 and 7 above the pistons 2 and 8 respectively and the conduit 6 are filled with hydraulic liquid and thus as the piston 8 moves upwards towards its top dead center position 9, the pressure in the hydraulic liquid is increased and the piston 2 is moved downwards towards its bottom dead-center position 4 and, conversely, as the piston 8 moves back towards its bottom dead-center position 10, the pressure of the hydraulic liquid is decreased and the piston 2 is drawn upwards towards its top dead-center position 3. Thus as the crank 12 rotates continuously, the piston 2 moves to and fro in the cylinder 1 and vibrates the vibratory plate. The movement of the exciter piston 2 through its top dead-center position 3 is cushioned by the resilience of the material which is being compacted by the vibratory plate, or alternatively, where this does not happen, a spring may be installed in the cylinder 1 to produce the necessary cushioning effect.

As an alternative to the single-acting arrangement shown in FIG. 1, the bottom end of the cylinder 7 may be closed and connected to the part of the cylinder 1 below the piston 2 so that the arrangement becomes double-acting.

Figure 2:
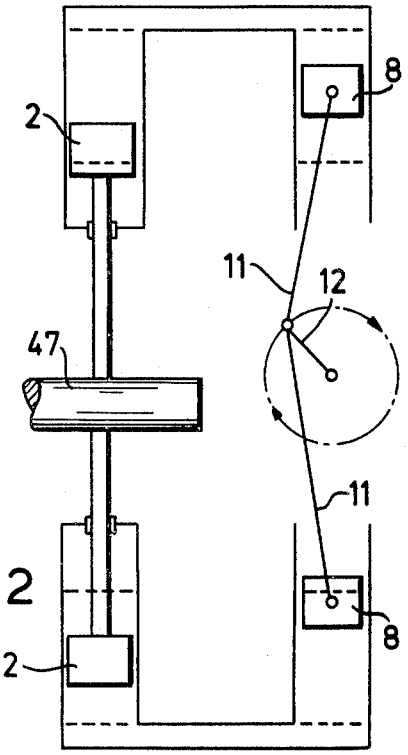
FIG. 2 is a side view of a second example in which again both the exciter cylinder and piston and the source are arranged as linear stroke motors, but both have twin cylinders and pistons to provide a double-acting arrangement.

The second example shown in FIG. 2 operates in fundamentally the same way as the example shown in FIG. 1 except that there are twin exciter cylinders each provided with an exciter piston 2 both of which are connected by piston rods to a vibratory compacting member 47. There are also two pressure source cylinders each provided with a piston 8 driven by a common crank 12 through two connecting rods 11. This arrangement is also, of course, double-acting. With this arrangement the compacting member 47 is vibrated in both directions with equal forces apart from the action of gravity upon it.

Figure 3:
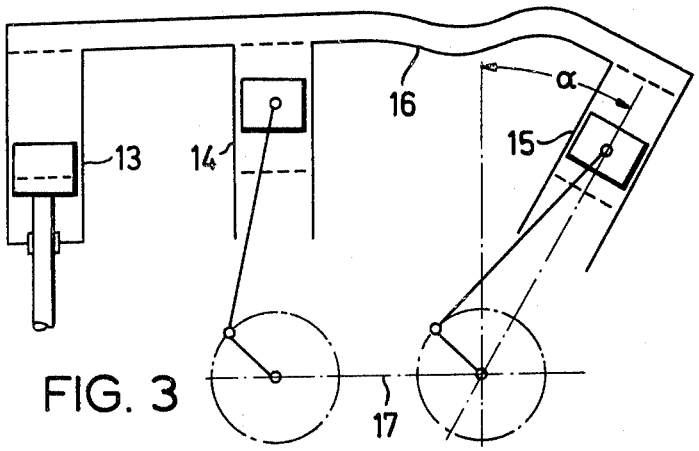
FIG. 3 is a side view of a third example in which a single exciter cylinder and piston is connected to a source comprising two cylinders and pistons.

The third example shown in FIG. 3 comprises an exciter cylinder 13 similar to the cylinder 1 and containing an exciter piston and this is connected by a conduit corresponding to the conduit 6 to a pressure source cylinder 14, which corresponds to the cylinder 7 in the first example, and by a second flexible conduit 16 to a second pressure source cylinder 15. The cylinder 15 contains a second piston driven by a second crank as shown and the two driving cranks are driven by a common crank shaft indicated diagrammatically by the line 17. The axis of the cylinder 15 intersects the axis of rotation of the shaft 17 and the cylinder 15 is mounted so that it can be swung around the axis of the shaft 17 to vary the phase relationship between the movement of the piston in the cylinder 15 and the movement of the piston in the cylinder 14. In the position shown in FIG. 3, the axis of the cylinder 15 lies at an angle $\alpha$ to the axis of the cylinder 14. The angle $\alpha$ can be adjusted from 0° to 180°. Thus the pistons in the cylinders 14 and 15 can move in phase with each other to increase the stroke of the piston in the cylinder 13 or they may move directly out of phase with each other so that the piston in the cylinder 13 does not move at all. The cylinder 15 may also be adjusted in any intermediate position between these two extremes. The power output of the exciter piston in the cylinder 13, which is dependent upon its stroke, may thus be adjusted smoothly from zero to a maximum.

Figure 4:
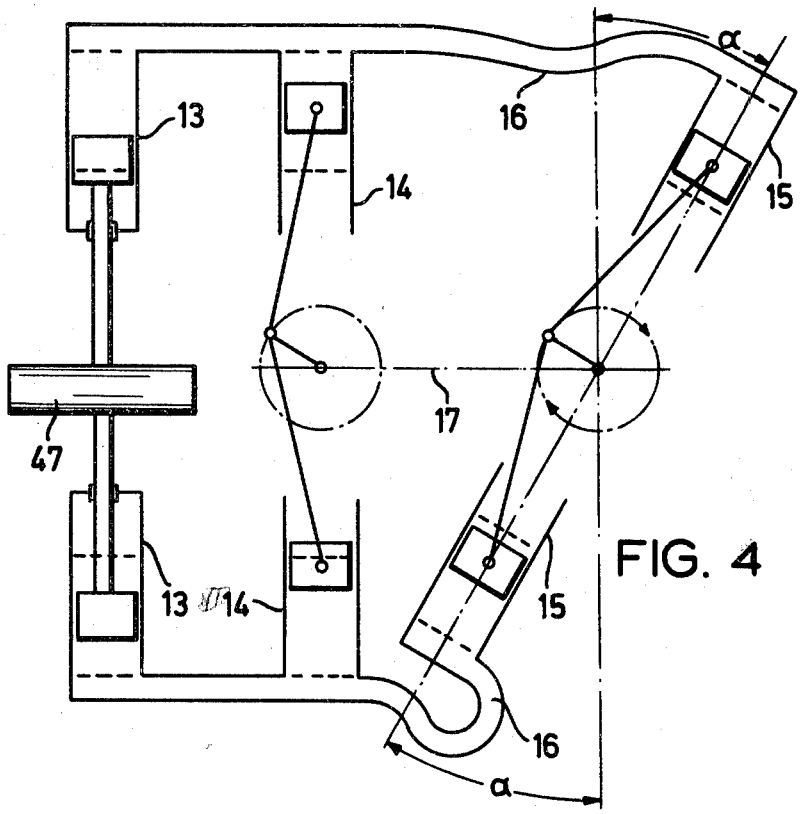
FIG. 4 is a side view of a fourth example operating on the same principle as the example of FIG. 3, but with a double-acting arrangement similar to FIG. 2.

The fourth example shown in FIG. 4 of the drawings bears just the same relationship to the example shown in FIG. 3 as the example shown in FIG. 2 bears to that shown in FIG. 1. That is to say there are twin exciter cylinders 13 and twin pairs of fluid pressure source cylinders 14 and 15. The pistons in the two cylinders 14 are driven by a common crank and so also are the pistons in the two cylinders 15. The two cranks are driven by a common shaft 17 and both the cylinders 15 can be swung together so that their common axis lies at an angle to the common axis of the cylinders 14.

This arrangement functions in the same way as the example shown in FIG. 3 except that it is, of course, double-acting.

Figure 5:
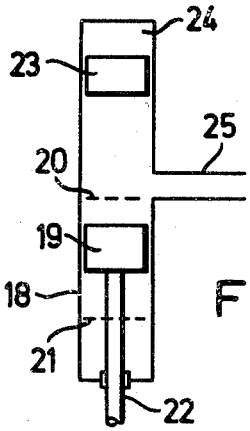
FIG. 5 is a side view of a fifth example.

In the example shown in FIG. 5, an exciter cylinder 18 contains in its lower part an exciter piston 19 which is movable between a top dead center position 20 and a bottom dead center position 21. The exciter piston 19 is connected by a piston rod 22 to a compactor member. A flexible conduit 25 leads from the middle of the cylinder 18 to a fluid pressure source which may be a cylinder and piston arrangement similar to the cylinder 7 and the piston 8 shown in the first example and the upper part of the cylinder 18 contains a free piston 23. The space below the free piston 23 is filled with the pressure fluid, but a space 24 within the cylinder 18 above the piston 23 is filled with gas under pressure.

With this arrangement, when hydraulic fluid under pressure is supplied and withdrawn through the conduit 25, the exciter piston 19 moves upwards and downwards, the upward movement being aided, as is well known, by a gas cushion below piston 19, and the free piston 23 also moves upwards and downwards always moving counter to the direction of movement of the piston 19. The gas in the space 24 contracts and expands as the piston 23 moves upwards and downwards and thus the piston 23 has a natural frequency of movement dependent upon the pressure of the gas in the space 24. Consequently it is possible to operate the vibration exciter at a resonant frequency and when this is done it is possible for the piston 19 to maintan either a large stroke with a given power input or a given stroke with a minimum power input.

The piston 23 with the gas space 24 above it may be substituted by a diaphragm or bellows which operates in the same way.

Figure 6:
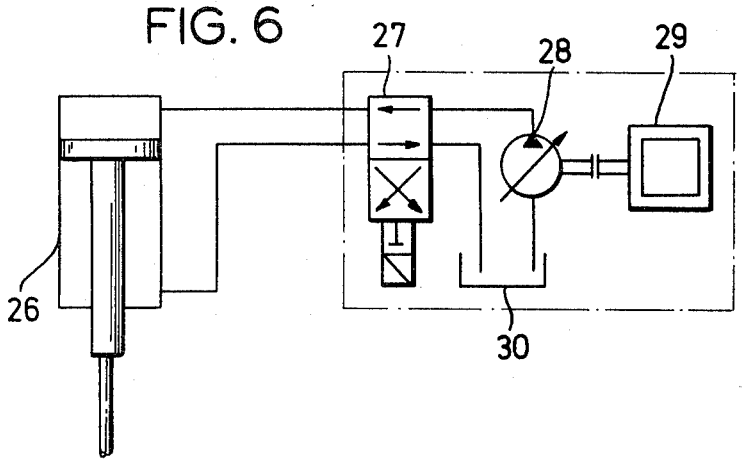
FIG. 6 is a side view of a sixth example in which the exciter cylinder is connected through a control valve to a hydraulic pressure pump which is arranged to produce a unidirectional flow of hydraulic fluid.

In the sixth example shown in FIG. 6, the exciter has an exciter cylinder 26 containing a double-acting piston which is connected by a piston rod to a compacting member which is not shown. The spaces on the two sides of the piston within the cylinder 26 are connected by flexible conduits through a control valve 27 to a hydraulic pressure pump 28 which is driven by a motor 29. The pump 28 has a suction port connected to a hydraulic fluid reservoir 30 and the control valve 27 has a discharge port leading to the reservoir 30.

The valve 27 is operated by a variable speed control motor which continuously alters the porting of the valve 27 so that alternately the space above the piston in the exciter cylinder 26 is connected through the valve 27 to the pump 28 and the space below the piston in the exciter 26 is connected through the valve 27 to the reservoir 30 and then the valve is changed over so that the space above the piston in the cylinder 26 is vented to the reservoir 30 and the space below the piston in the cylinder 26 is connected to the pump 28 and so on. Thus the exciter piston in the cylinder 26 is moved to and fro upwards and downwards at a frequency which is determined by the frequency of operation of the valve 27.

The stroke of the piston in the exciter cylinder 26 can be regulated at any programmed frequency in any one of the three following ways:- Firstly with a constant pressure output from the pump 28, both the frequency of operation of the valve 27 may be altered and the time for which the valve is open in each direction may be altered so that both the volume of liquid flowing into the two ends of the cylinder 26 is altered and the frequency of reversal is altered. Secondly the volume output of the pump 28 may be maintained constant and the pressure may be varied and a device such as the piston 23 shown in FIG. 5 may be provided to absorb the movement of excess quantities of liquid. Thus with a constant frequency of operation of the valve 27, the stroke of the piston in the cylinder 26 will increase as the pressure increases. Thirdly, the pressure and volume of flow of the output from the pump 28 may be maintained constant and the volume of liquid entering the cylinder 26 is then varied by varying the flow area within the valve 27. In this case some means must again be provided for absorbing excess flow from the pump 28 when the flow into the cylinder 26 is restricted.

Of these three methods of control, the first is preferred.

Figure 7:
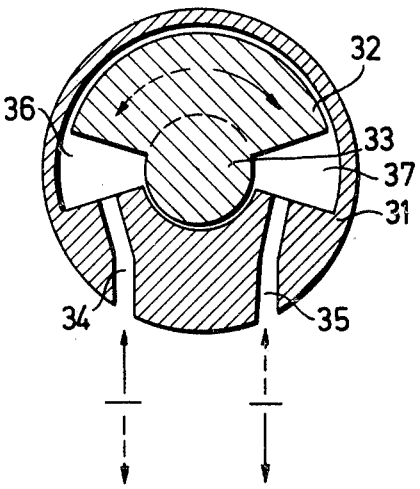
FIG. 7 is a cross-section through the exciter cylinder and piston of a seventh example which incorporates an oscillating piston motor; and, FIG. 8 is a cross-section similar to FIG. 7, but of an eighth example incorporating a different form of oscillating piston motor.

In all the examples so far described, the exciter cylinder and piston form a linear stroke motor, but in the example shown in FIG. 7, the exciter is in the form of an oscillating piston motor.

As shown in FIG. 7, a housing 31 forms an exciter cylinder and it contains an oscillating piston or vane 32 fixed to a shaft 33 which, in turn, is attached to a compacting member. The oscillating piston 32 is double-acting and the housing 31 has two inlet and outlet ports 34 and 35 leading to spaces 36 and 37 respectively on the two sides of the piston 32.

The ports 34 and 35 are connected by flexible conduits to a source of hydraulic fluid under pressure and this source may be in the form of a double-acting piston and cylinder, or twin pistons and cylinders similar to that shown in FIG. 2 or alternatively the source may consist of a unidirectional hydraulic pressure pump together with a control valve similar to the arrangement shown in FIG. 6.

The example shown in FIG. 8 again includes an oscillating piston motor, but instead of having a single piston 32 as shown in FIG. 7, it includes a housing 38 forming a cylinder containing two pistons 39 fixed to a shaft 40. The housing 38 has two pairs of inlet and outlet ports 41 and 42 leading to spaces 43 to 46 on the two sides of the piston 39.

Figure 8:
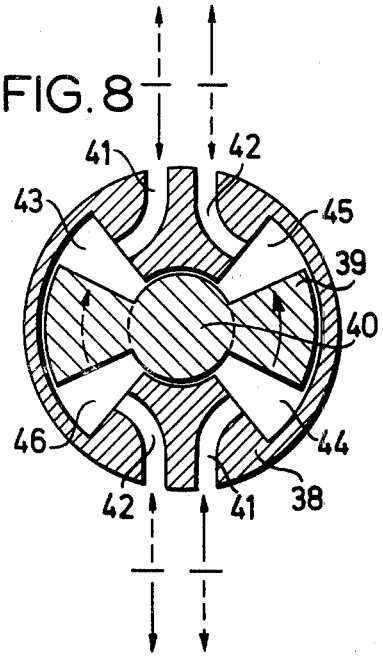

The example shown in FIG. 8 is connected to a source similar to that described with reference to FIG. 7 and it operates in the same way.

Because there are two pistons 39, their angular stroke is somewhat less than that of the single piston 32, but, for a given hydraulic fluid supply pressure, the torque acting on the shaft 40 is increased and therefore the power output of the exciter may be greater than that of the example shown in FIG. 7.

As a further alternative, the exciter, when of the oscillating piston type, may have any even number of oscillating pistons.

The examples shown in FIGS. 7 and 8 may also be provided in the hydralic fluid supply with a resonant cushioning piston similar to the pistion 23 shown in FIG. 5.

Exciters in accordance with the invention may be constructed in a compact manner and for this reason it is possible for a number of them to be connected in parallel to act upon a single compactor member and thus greatly increased vibration power output can be obtained. It is possible with exciters in accordance with the invention to produce an exciter unit comprising a number of exciter cylinder and piston assemblies constructed as shown in any of the drawings. The possibility of constructing the exciter in this unit fashion provides possibilities of rationalisation in production and economies in development and storage.

In all the examples illustrated, the exciter piston or pistons are connected to the compactor member and the exciter cylinder remains stationary. As an alternative to this, though, it is possible in all the examples for the exciter to be constructed so that the piston remains stationary and the exciter cylinder is connected to the compacting member and moves to and fro on the piston.

I claim:

1. An hydraulic exciter for vibrations for a vibratory compactor comprising:

relatively movable exciter piston and cylinder means, one of which is adapted to be connected to a compacting member for transmitting power thereto as said piston means moves relative to said cylinder means;

means for delivering to said piston and cylinder means a pressure medium producing a pressure which varies cyclically at a selected frequency in a manner to cause relative vibratory movement between said piston means and said cylinder means; and means including a cylinder, a free piston in said cylinder and having one side in communication with the pressure medium, and a mass of gas under pressure disposed in said cylinder at the side of said free piston opposite from that in communication with the pressure medium, said free piston undergoing movement counter to that of said exciter piston and having a natural frequency of movement under the influence of the cyclically varying pressure, which natural frequency of movement is determined by the pressure of the gas in said cylinder, for influencing the relative movement of said exciter piston and cylinder means to produce movement of said exciter piston and said free piston at a resonant frequency of said exciter, which resonant frequency is substantially equal to the selected frequency of the cyclic pressure variation of the pressure medium.

* * * * *